US007100301B1

(12) United States Patent
Humphrey et al.

(10) Patent No.: US 7,100,301 B1
(45) Date of Patent: Sep. 5, 2006

(54) COMBUSTIBLE GRAIN DRYING SYSTEM FOR PRODUCING ENERGY BYPRODUCT

(76) Inventors: Jason C. Humphrey, 4346 S. Detroit Ave., Apt. 20, Toledo, OH (US) 43614; Robert E. Pitts, P.O. Box 351210, Toledo, OH (US) 43635

( * ) Notice: Subject to any disclaimer, the term of this patent is extended or adjusted under 35 U.S.C. 154(b) by 0 days.

(21) Appl. No.: 11/053,532

(22) Filed: Feb. 9, 2005

(51) Int. Cl.
*F26B 19/00* (2006.01)

(52) U.S. Cl. ..... 34/86; 34/174; 432/15

(58) Field of Classification Search ..... 34/60, 34/61, 86, 90, 215, 218, 168, 174, 17; 432/15, 432/96

See application file for complete search history.

(56) References Cited

U.S. PATENT DOCUMENTS 4,289,481 A 9/1981 Yano
4,333,405 A 6/1982 Michelfelder et al.
4,368,583 A 1/1983 Bauermeister
4,424,634 A * 1/1984 Westelaken ..... 34/167
4,474,120 A 10/1984 Adrain et al.
4,509,273 A * 4/1985 Roisen ..... 34/86
4,790,748 A 12/1988 Litt et al.
4,823,712 A * 4/1989 Wormer ..... 110/245
5,033,208 A 7/1991 Ohmo et al.
5,882,381 A * 3/1999 Hauck et al. ..... 95/109
6,230,421 B1 * 5/2001 Reed et al. ..... 34/401

* cited by examiner

*Primary Examiner*—S. Gravini

(57) ABSTRACT

A system for drying grain includes a receiving bin defining a cavity therein and further includes intake and outlet ports. A conduit is operably connected to the receiving bin that includes a plurality of check valves and a stop valve. The system further includes a mechanism for introducing air at a selected flow rate into the conduit and a combustion source that includes a pilot gas light wherein fire is created that burns between 2000–3000 degrees Fahrenheit. The combustion source includes a flue positioned thereabove and a drain outlet extending substantially orthogonal to the conduit. A heat exchanger is connected to the combustion source including a fan and a filter operably connected thereto.

15 Claims, 1 Drawing Sheet

COMBUSTIBLE GRAIN DRYING SYSTEM FOR PRODUCING ENERGY BYPRODUCT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a grain drying system and, more particularly, to a combustible grain drying system for producing energy byproduct.

2. Prior Art

It is known to dry grain to enhance its storage characteristics. In a typical grain drying apparatus, oil or coal is burned to provide hot gases which are circulated throughout the grain to dry it. Such a process is expensive because of the high prices for coal or oil. Typically, such a grain dehydrator has an oil or gas furnace that produces hot gases for drying the grain. A cyclone-type separator separates the dried grain from gaseous odors, which are then re-burned for supplementing the hot gases from the furnace.

The burning of agricultural waste products to produce heat is also known. In this case an apparatus directs combustible material, such as the hulls of rice, to a furnace to produce a swirling flow of combustible products. A fluidized bed is also known for combustion processes wherein such fluidized bed reactors burn material. In each of these devices, the desired output heat is obtained by a heat exchanger in contact with the fluidized bed.

The cost of energy (dollars per million BTU's) from the burning of corn and wheat is comparable to that from oil, gasoline and liquified gas, but much higher (two to three times) than that from coal. While grain dust (emissions) represents about 0.4 percent of the total U.S. grain production, the available grain dust emissions are a viable fuel source for the approximately 8,000 country, inland terminal and port terminal grain facilities located throughout the United States. They provide a safe, nonpolluting way to eliminate a very dangerous pollution source. At an essentially zero resource cost, they provide a substantial reduction in grain-elevator heating and/or power costs.

Accordingly, a need remains for a combustible grain drying system for producing energy byproduct in order to overcome the above-noted shortcomings. The present invention satisfies such a need by providing a grain drying system that is efficient, cost-effective and adaptable to use on most typical grain dryers. Such a grain drying system advantageously provides steam for the production of electricity or general plant use. The system conveniently uses grain dust as an essentially free source of energy while advantageously resulting in very low amounts of pollution produced and emitted.

BRIEF SUMMARY OF THE INVENTION

In view of the foregoing background, it is therefore an object of the present invention to provide a combustible grain drying system for producing energy byproduct. These and other objects, features, and advantages of the invention are provided by a system for burning industrial grain dust to create heat and power grain dryers.

The system includes a receiving bin defining a cavity therein and further includes oppositely disposed intake and outlet ports in fluid communication with the cavity wherein the intake port may be disposed above the outlet port. Such a receiving bin accepts particulate materials through the intake port and guides the particulate materials along a substantially vertical path downwardly therethrough and towards the outlet port wherein gravity displaces the particulate materials at a predetermined rate. The receiving bin has a lower portion provided with an outer surface converging downwardly towards the outlet port.

A conduit has a first end portion operably connected to the receiving bin and further has a second end portion disposed downstream therefrom along a substantially horizontal plane. Such a conduit includes a plurality of check valves spaced along a length thereof for conveniently controlling the flow rate of the particulate materials. The conduit further includes a stop valve downstream of the check valves for cooperating therewith and restricting the flow of the particulate materials.

The system further includes a mechanism for introducing air at a selected flow rate into the conduit and downstream of the outlet port. Such an air-introducing mechanism advantageously assists to direct the particulate materials through the conduit and away from the receiving bin wherein combustion is promoted during operating conditions. The air-introducing mechanism may include an air-lock valve positioned adjacent to the outlet port and a fan disposed to an exterior of the receiving bin and operably connected thereto. A mixing chamber is in fluid communication with the air-lock valve and the fan for homogenizing the particulate materials air upstream of the check valves so that the combustion source can advantageously receive a continuous flow of particulate materials during operating conditions.

The combustion source includes a pilot gas light wherein fire is created that burns between 2000–3000 degrees Fahrenheit, advantageously atomizing the particulate materials and producing a smokeless hot gas byproduct. Such a combustion source is in fluid communication with the second end portion of the conduit for receiving the particulate materials therefrom and releasing the hot gas along a controlled path.

The combustion source further includes a flue positioned thereabove for advantageously directing the hot gas along the controlled path and away from the conduit. Such a combustion source further includes a drain outlet extending substantially orthogonal to the conduit for conveniently directing ash byproduct away from the flue. The system preferably further includes an exhaust conduit in fluid communication with the combustion source and also includes a stop member for allowing a user to selectively bifurcate a portion of the particulate materials away from the flue.

A heat exchanger is operably connected to the combustion source for effectively separating hot gas from the particulate materials remaining within the controlled path. Such a heat exchanger includes a fan and a filter operably connected thereto for drawing selected hot gas away from the flue while channeling remaining hot gas back towards the flue.

The heat exchanger is preferably disposed downstream of the air-introducing mechanism.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
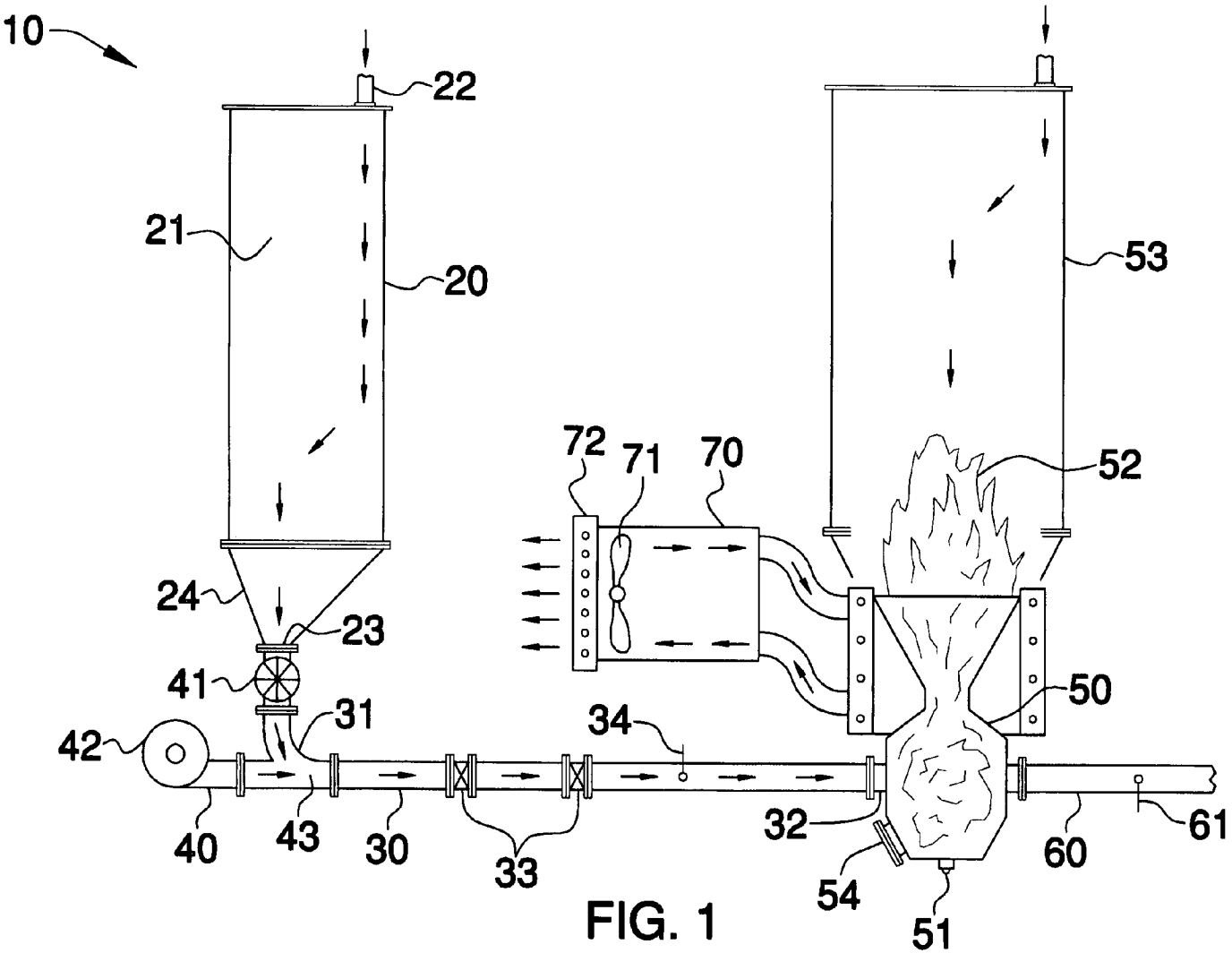
FIG. 1 is a side elevational view showing a combustible grain drying system for producing energy byproduct, in accordance with the present invention.

The present invention will now be described more fully hereinafter with reference to the accompanying drawing, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the FIGURE.

The system of this invention is referred to generally in FIG. 1 by the reference numeral 10 and is intended to provide a grain drying system for producing an energy byproduct. It should be understood that the system 10 may be used to dry many different types of agricultural products and should not be limited to drying only grain.

Referring initially to FIG. 1, the system 10 includes a receiving bin 20 defining a cavity 21 therein and further includes oppositely disposed intake 22 and outlet 23 ports in fluid communication with the cavity 21 wherein the intake port 22 is disposed above the outlet port 23. Such a receiving bin 20 accepts particulate materials 25 through the intake port 22 and guides the particulate materials 25 along a substantially vertical path downwardly therethrough and towards the outlet port 23 wherein gravity displaces the particulate materials 25 at a predetermined rate. The receiving bin 20 has a lower portion 24 provided with an outer surface converging downwardly towards the outlet port 23.

Still referring to FIG. 1, a conduit 30 has a first end portion 31 operably connected to the receiving bin 20 and further has a second end portion 32 disposed downstream therefrom along a substantially horizontal plane. Such a conduit 30 includes a plurality of check valves 33 spaced along a length thereof for conveniently controlling the flow rate of the particulate materials 25. This feature advantageously allows the burning rate of the system 10 to be adjusted so that a maximum amount of heat will be produced with a minimum amount of airflow. This in turn increases the amount of energy that can be extracted from a selected amount of particulate materials 25. The conduit 30 further includes a stop valve 34 downstream of the check valves 33 for cooperating therewith and restricting the flow of the particulate materials 25.

Still referring to FIG. 1, the system 10 further includes a mechanism 40 for introducing air at a selected flow rate into the conduit 30 and downstream of the outlet port 23. Such an air-introducing mechanism 40 advantageously assists to direct the particulate materials 25 through the conduit 30 and away from the receiving bin 20 wherein combustion is promoted during operating conditions and clogging of the mixing chamber 43 (described herein below) is prevented. The air-introducing mechanism 40 includes an air-lock valve 41 positioned adjacent to the outlet port 23 and a fan 42 disposed to an exterior of the receiving bin 20 and operably connected thereto. A mixing chamber 43 is in fluid communication with the air-lock valve 41 and the fan 42 for homogenizing the particulate materials air upstream of the check valves 33 so that the combustion source 50 (described herein below) can advantageously receive a continuous flow of particulate materials 25 during operating conditions.

Still referring to FIG. 1, the combustion source 50 includes a pilot gas light 51 wherein fire 52 is created that burns between 2000–3000 degrees Fahrenheit, advantageously atomizing the particulate materials 25 and producing a smokeless hot gas byproduct. Advantageously, the atomizing of such particulate materials 25 significantly decreases the amount of air pollution caused by the system 10. As a result, the hot gas byproduct can simultaneously be used to energize other operations, such as grain drying. Such a combustion source 50 is in fluid communication with the second end portion 32 of the conduit 30 for receiving the particulate materials 25 therefrom and releasing the hot gas along a controlled path.

Still referring to FIG. 1, the combustion source 50 further includes a flue 53 positioned thereabove for advantageously directing the hot gas along the controlled path and away from the conduit 30. Such a combustion source 50 further includes a drain outlet 54 extending substantially orthogonal to the conduit 30 for conveniently directing ash byproduct away from the flue 53. The system 10 further includes an exhaust conduit 60 in fluid communication with the combustion source 50 and also includes a stop member 61 for allowing a user to selectively bifurcate a portion of the particulate materials 25 away from the flue 53. Of course an exhaust conduit 60 may be attached to the drain outlet 54 in order to conveniently direct ash byproduct further away from the combustion source 50 as may be desired by the user.

Still referring to FIG. 1, a heat exchanger 70 is operably connected to the combustion source 50 for effectively separating hot gas from the particulate materials 25 remaining within the controlled path. Such a heat exchanger 70 includes a fan 71 and a filter 72 operably connected thereto for drawing selected hot gas away from the flue 53 while channeling remaining hot gas back towards the flue 53. The heat exchanger 70 is disposed downstream of the air-introducing mechanism 40.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A system for burning industrial grain dust to create heat and power grain dryers, said system comprising:

a receiving bin defining a cavity therein and including oppositely disposed intake and outlet ports in fluid communication with the cavity, said receiving bin for accepting particulate materials through said intake port and guiding the particulate materials along a substantially vertical path downwardly therethrough and towards said outlet port wherein gravity displaces the particulate materials at a predetermined rate;

a conduit having a first end portion operably connected to said receiving bin and further having a second end portion disposed downstream therefrom along a substantially horizontal plane, said conduit comprising a plurality of check valves spaced along a length thereof for controlling the flow rate of the particulate materials, said conduit further including a stop valve downstream of said check valves for cooperating therewith and restricting the flow of the particulate materials;

means for introducing air at a selected flow rate into said conduit and downstream of said outlet port, said air-introducing means for assisting to direct the particulate materials through said conduit and away from said receiving bin wherein combustion is promoted during operating conditions;

a combustion source comprising a pilot gas light wherein fire is created and burns between 2000–3000 degrees Fahrenheit for atomizing the particulate materials and producing a smokeless hot gas byproduct, said combustion source being in fluid communication with said second end portion of said conduit for receiving the particulate materials therefrom and releasing the hot gas along a controlled path, said combustion source further including a flue positioned thereabove for directing the hot gas along the controlled path and away from said conduit; and a heat exchanger operably connected to said combustion source for separating hot gas from the particulate materials remaining within the controlled path, said heat exchanger including a fan and a filter operably connected thereto and for drawing selected hot gas away from said flue while channeling remaining hot gas back towards said flue.

2. The system of claim 1, further comprising an exhaust conduit in fluid communication with said combustion source and including a stop member for allowing a user to selectively bifurcate a portion of the particulate materials away from said flue.

3. The system of claim 1, wherein said heat exchanger is disposed downstream of said air-introducing means.

4. The system of claim 1, said air-introducing means comprises:

an air-lock valve positioned adjacent said outlet port;

a fan disposed exterior of said receiving bin and operably connected thereto; and a mixing chamber in fluid communication with said air-lock valve and said fan for homogenizing the particulate materials air upstream of said check valves so that said combustion source can receive a continuous flow of particulate materials during operating conditions.

5. The system of claim 1, said intake port is disposed above said outlet port.

6. A system for burning industrial grain dust to create heat and power grain dryers, said system comprising:

a receiving bin defining a cavity therein and including oppositely disposed intake and outlet ports in fluid communication with the cavity, said receiving bin for accepting particulate materials through said intake port and guiding the particulate materials along a substantially vertical path downwardly therethrough and towards said outlet port wherein gravity displaces the particulate materials at a predetermined rate, said receiving bin having a lower portion provided with an outer surface converging downwardly towards said outlet port;

a conduit having a first end portion operably connected to said receiving bin and further having a second end portion disposed downstream therefrom along a substantially horizontal plane, said conduit comprising a plurality of check valves spaced along a length thereof for controlling the flow rate of the particulate materials, said conduit further including a stop valve downstream of said check valves for cooperating therewith and restricting the flow of the particulate materials;

means for introducing air at a selected flow rate into said conduit and downstream of said outlet port, said air-introducing means for assisting to direct the particulate materials through said conduit and away from said receiving bin wherein combustion is promoted during operating conditions;

a combustion source comprising a pilot gas light wherein fire is created and burns between 2000–3000 degrees Fahrenheit for atomizing the particulate materials and producing a smokeless hot gas byproduct, said combustion source being in fluid communication with said second end portion of said conduit for receiving the particulate materials therefrom and releasing the hot gas along a controlled path, said combustion source further including a flue positioned thereabove for directing the hot gas along the controlled path and away from said conduit; and a heat exchanger operably connected to said combustion source for separating hot gas from the particulate materials remaining within the controlled path, said heat exchanger including a fan and a filter operably connected thereto and for drawing selected hot gas away from said flue while channeling remaining hot gas back towards said flue.

7. The system of claim 6, further comprising an exhaust conduit in fluid communication with said combustion source and including a stop member for allowing a user to selectively bifurcate a portion of the particulate materials away from said flue.

8. The system of claim 6, wherein said heat exchanger is disposed downstream of said air-introducing means.

9. The system of claim 6, said air-introducing means comprises:

an air-lock valve positioned adjacent said outlet port;

a fan disposed exterior of said receiving bin and operably connected thereto; and a mixing chamber in fluid communication with said air-lock valve and said fan for homogenizing the particulate materials air upstream of said check valves so that said combustion source can receive a continuous flow of particulate materials during operating conditions.

10. The system of claim 6, said intake port is disposed above said outlet port.

11. A system for burning industrial grain dust to create heat and power grain dryers, said system comprising:

a receiving bin defining a cavity therein and including oppositely disposed intake and outlet ports in fluid communication with the cavity, said receiving bin for accepting particulate materials through said intake port and guiding the particulate materials along a substantially vertical path downwardly therethrough and towards said outlet port wherein gravity displaces the particulate materials at a predetermined rate, said receiving bin having a lower portion provided with an outer surface converging downwardly towards said outlet port;

a conduit having a first end portion operably connected to said receiving bin and further having a second end portion disposed downstream therefrom along a substantially horizontal plane, said conduit comprising a plurality of check valves spaced along a length thereof for controlling the flow rate of the particulate materials, said conduit further including a stop valve downstream of said check valves for cooperating therewith and restricting the flow of the particulate materials;

means for introducing air at a selected flow rate into said conduit and downstream of said outlet port, said air-introducing means for assisting to direct the particulate materials through said conduit and away from said receiving bin wherein combustion is promoted during operating conditions;

a combustion source comprising a pilot gas light wherein fire is created and burns between 2000–3000 degrees Fahrenheit for atomizing the particulate materials and producing a smokeless hot gas byproduct, said combustion source being in fluid communication with said second end portion of said conduit for receiving the particulate materials therefrom and releasing the hot gas along a controlled path, said combustion source further including a flue positioned thereabove for directing the hot gas along the controlled path and away from said conduit, said combustion source further including a drain outlet extending substantially orthogonal to said conduit for directly ash byproduct away from said flue; and a heat exchanger operably connected to said combustion source for separating hot gas from the particulate materials remaining within the controlled path, said heat exchanger including a fan and a filter operably connected thereto and for drawing selected hot gas away from said flue while channeling remaining hot gas back towards said flue.

12. The system of claim 11, further comprising an exhaust conduit in fluid communication with said combustion source and including a stop member for allowing a user to selectively bifurcate a portion of the particulate materials away from said flue.

13. The system of claim 11, wherein said heat exchanger is disposed downstream of said air-introducing means.

14. The system of claim 11, said air-introducing means comprises:

an air-lock valve positioned adjacent said outlet port;

a fan disposed exterior of said receiving bin and operably connected thereto; and a mixing chamber in fluid communication with said air-lock valve and said fan for homogenizing the particulate materials air upstream of said check valves so that said combustion source can receive a continuous flow of particulate materials during operating conditions.

15. The system of claim 11, said intake port is disposed above said outlet port.

* * * * *